US009488381B2

(12) United States Patent
Yasutomi et al.

(10) Patent No.: US 9,488,381 B2
(45) Date of Patent: Nov. 8, 2016

(54) AIR-CONDITIONING INDOOR UNIT

(71) Applicant: DAIKIN INDUSTRIES, LTD., Osaka-shi, Osaka (JP)

(72) Inventors: Masanao Yasutomi, Kusatsu (JP); Masashi Kamada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 106 days.

(21) Appl. No.: 14/354,896

(22) PCT Filed: Oct. 2, 2012

(86) PCT No.: PCT/JP2012/075462
§ 371 (c)(1),
(2) Date: Apr. 28, 2014

(87) PCT Pub. No.: WO2013/065438
PCT Pub. Date: May 10, 2013

(65) Prior Publication Data

US 2014/0308888 A1 Oct. 16, 2014

(30) Foreign Application Priority Data

Oct. 31, 2011 (JP) ..... 2011-239778

(51) Int. Cl.
*F24F 13/10* (2006.01)
*F24F 13/14* (2006.01)
(Continued)

(52) U.S. Cl.
CPC ..... *F24F 13/10* (2013.01); *F24F 1/0011* (2013.01); *F24F 11/0078* (2013.01); *F24F 13/14* (2013.01); *F24F 2001/0037* (2013.01); *F24F 2221/28* (2013.01)

(58) Field of Classification Search
USPC ..... 454/284
See application file for complete search history.

(56) References Cited

U.S. PATENT DOCUMENTS 4,350,472 A * 9/1982 Morimoto ..... 415/125
4,607,565 A * 8/1986 Sugawara et al. ..... 454/319
(Continued)

FOREIGN PATENT DOCUMENTS

EP 1 707 892 A1 11/2004
EP 1 553 361 A1 7/2005
(Continued)

OTHER PUBLICATIONS

International Preliminary Report of corresponding PCT Application No. PCT/JP2012/075462 dated May 15, 2014.
(Continued)

*Primary Examiner* — Gregory Huson
*Assistant Examiner* — Martha Becton
(74) *Attorney, Agent, or Firm* — Global IP Counselors

(57) ABSTRACT

An air-conditioning indoor unit is operable in a Coanda effect use mode in which blown air from a blow-out port is diverted in a predetermined direction. The indoor unit includes a scroll leading conditioned air to the blow-out port, a Coanda vane in proximity to the blow-out port, and a controller controlling orientation of the Coanda vane. The Coanda vane alters an airflow direction of the blown air via the Coanda effect and turns the blown air into a Coanda airflow along a bottom surface of the Coanda vane. A convex shaped curved surface formed in the bottom surface of the Coanda vane has a radius of 50 to 300 mm. The controller adjusts the orientation of the Coanda vane away from a casing front surface as the Coanda vane separates from the blow-out port in the Coanda effect use mode.

6 Claims, 11 Drawing Sheets

(51) Int. Cl.
*F24F 1/00* (2011.01)
*F24F 11/00* (2006.01)

(56) References Cited

U.S. PATENT DOCUMENTS

| | | | | |
|---|---|---|---|---|
| 5,762,034 | A * | 6/1998 | Foss | 123/41.49 |
| 5,771,708 | A * | 6/1998 | Suzuki et al. | 62/285 |
| 2010/0026034 | A1* | 2/2010 | Storgato et al. | 296/70 |
| 2011/0010958 | A1* | 1/2011 | Clark et al. | 34/97 |
| 2012/0168117 | A1* | 7/2012 | Jairazbhoy et al. | 165/48.1 |
| 2013/0286673 | A1* | 10/2013 | Umlauft et al. | 362/470 |
| 2013/0303071 | A1* | 11/2013 | Seki | 454/155 |
| 2014/0134939 | A1* | 5/2014 | Kamada et al. | 454/309 |

FOREIGN PATENT DOCUMENTS

| | | | |
|---|---|---|---|
| EP | 1 975 552 | A1 | 10/2008 |
| JP | 10-9659 | A | 1/1998 |
| JP | 2002-295888 | A | 10/2002 |
| JP | 2003-232531 | A | 8/2003 |
| JP | 2004-361011 | A | 12/2004 |
| JP | 2007-51866 | A | 3/2007 |
| JP | 2011-214727 | A | 10/2011 |
| JP | 2012-197970 | A | 10/2012 |

OTHER PUBLICATIONS

European Search Report of corresponding EP Application No. 12 84 6065.6 dated Dec. 4, 2014.

Air Confitioner Tokesen Pamphlet S X Series, Panasonic Corp., Oct. 1, 2011, cover page, pp. 5, 6, 10 and 11.

International Search Report of corresponding PCT Application No. PCT/JP2012/075462.

* cited by examiner

AIR-CONDITIONING INDOOR UNIT

CROSS-REFERENCE TO RELATED APPLICATIONS

This U.S. National stage application claims priority under 35 U.S.C. §119(a) to Japanese Patent Application No. 2011-239778, filed in Japan on Oct. 31, 2011, the entire contents of which are hereby incorporated herein by reference.

TECHNICAL FIELD

The present invention relates to an air-conditioning indoor unit.

BACKGROUND ART

Recently there has been investigation of air conditioners that use the Coanda effect to bring the blown air to a predetermined zone. For example, the air conditioner disclosed in Patent Literature 1 (Japanese Laid-open Patent Application Publication No. 2003-232531) is configured with a horizontal louver disposed in the front surface of a blow-out port and in the path of blown air. The blown air is an upward Coanda airflow along the horizontal louver due to the Coanda effect.

SUMMARY OF INVENTION

Technical Problem

The upward Coanda airflow is a cause of so-called short circuits drawn into an intake port along a casing front surface, and it is therefore necessary in this air conditioner for the Coanda airflow to be corrected to an upward incline by an airflow guide plate.

Therefore, there is demand for a configuration that creates a Coanda airflow which avoids short circuits even without such an airflow guide plate.

An object of the present invention is to provide an air conditioner that can create a Coanda airflow in a direction that avoids short circuits even without a conventional airflow guide plate.

Solution to Problem

An air-conditioning indoor unit according to a first aspect of the present invention is an air-conditioning indoor unit having a Coanda effect use mode in which a flow of blown air blown out from a blow-out port is diverted in a predetermined direction via the Coanda effect, the air-conditioning indoor unit comprising a Coanda vane and a controller. The Coanda vane, which is provided in proximity to the blow-out port, makes the blown air into a Coanda airflow along a bottom surface thereof during the Coanda effect use mode. The controller controls the orientation of the Coanda vane. A curved surface curved into a convex shape is formed in the bottom surface of the Coanda vane. The controller adjusts the orientation of the Coanda vane away from a casing front surface as the Coanda vane separates from the blow-out port during the Coanda effect use mode.

In this air-conditioning indoor unit, because the orientation of the Coanda vane is such that the Coanda vane separates from the casing front surface as the Coanda vane separates from the blow-out port, the Coanda airflow along the curved surface of the Coanda vane can progress upward while separating from the casing front surface. As a result, upward blowing of the blown air can be achieved, and short circuiting can be prevented even though the intake port is above the casing front surface. Furthermore, because the bottom surface of the Coanda vane is curved into a convex shape, the angle of the distal end of the Coanda vane is more of an upward angle than when the Coanda vane has a flat plate shape, and an upward air flow can be created without making the incline angle of the Coanda vane a steep angle. Therefore, a distance between the distal end of the Coanda vane and the casing front surface can be ensured, and a Coanda airflow free of short circuiting can be created.

An air-conditioning indoor unit according to a second aspect of the present invention is the air-conditioning indoor unit according to the first aspect, further comprising a scroll. The scroll leads conditioned air to the blow-out port. A tangent to a final end of the scroll is oriented downward. The controller adjusts the orientation of the Coanda vane so that the distal end of the Coanda vane is oriented upward during the Coanda effect use mode.

A conventional air-conditioning indoor unit has the Coanda vane disposed in the front surface of the blow-out port and in the path through which the blown air passes, and the Coanda airflow given an upward orientation by the Coanda vane must therefore be corrected to an upward incline by an airflow guide plate so that the Coanda airflow is not drawn along the casing front surface into the intake port.

However, in this air-conditioning indoor unit, the distal end of the Coanda vane has an upward orientation. As a result, even though the tangent to the final end of the scroll is oriented downward, the blown air is an upward Coanda airflow along the curved surface of the Coanda vane, and the blown air is also an airflow free of short circuiting even without a conventional airflow guide plate.

An air-conditioning indoor unit according to a third aspect of the present invention is the air-conditioning indoor unit according to the first aspect, wherein the controller adjusts the orientation of the Coanda vane during the Coanda effect use mode so that the distal end of the Coanda vane is oriented toward the ceiling.

A conventional air-conditioning indoor unit has the Coanda vane disposed in the front surface of the blow-out port and in the path through which the blown air passes, and the created Coanda airflow must therefore be corrected in a direction away from the casing front surface by an airflow guide plate for preventing short circuiting even if the distal end of the Coanda vane is oriented toward the ceiling. However, in this air-conditioning indoor unit, because the distal end of the Coanda vane is oriented toward the ceiling, the Coanda airflow flowing along the curved surface of the Coanda vane can progress toward the ceiling while separating from the casing front surface. As a result, ceiling blowing of air can be achieved, and short circuiting can be prevented even though the intake port is above the casing front surface.

An air-conditioning indoor unit according to a fourth aspect of the present invention is the air-conditioning indoor unit according to the third aspect, wherein when the distal end of the Coanda vane is oriented toward the ceiling, the controller adjusts the orientation of the Coanda vane so that the distal end of the Coanda vane is positioned higher than the top wall of the blow-out port.

In this air-conditioning indoor unit, because the distal end of the Coanda vane is positioned higher than the top wall in the farthest downstream side of the blow-out port, in the top side of the Coanda vane, the airflow is suppressed from progressing straight at a downward incline along the bottom wall in the farthest downstream side of the blow-out port, and the upward diversion of the Coanda airflow is therefore not likely to be inhibited.

An air-conditioning indoor unit according to a fifth aspect of the present invention is the air-conditioning indoor unit according to the first aspect, further having a normal mode in which the Coanda vane does not create a Coanda airflow. An accommodation part for accommodating the Coanda vane is formed in the casing front surface. In the normal mode, the Coanda vane is accommodated in the accommodation part and the casing front surface and the curved surface of the Coanda vane are curved so as to be aligned in a single continuous imaginary curved plane.

In this air-conditioning indoor unit, the casing front surface has a good appearance when the Coanda vane is accommodated, and the design is not compromised.

An air-conditioning indoor unit according to a sixth aspect of the present invention is the air-conditioning indoor unit according to the first aspect, wherein the curved surface of the Coanda vane is funned from a plurality of curved surfaces having different degrees of curvature.

In this air-conditioning indoor unit, when an attempt is made to deflect all the airflow with a single curved surface in order to increase the degree of deflection from the direction of the blown air to the direction of the Coanda airflow, there is a possibility of the Coanda airflow separating from the curved surface. However, by gradually increasing the degree of deflection with a plurality of curved surfaces, the breaking away of the Coanda airflow from the curved surface can be suppressed, and the degree of deflection can be increased from the direction of the blown air to the direction of the Coanda airflow.

An air-conditioning indoor unit according to a seventh aspect of the present invention is the air-conditioning indoor unit according to the first aspect, further comprising a movable airflow direction adjustment vane for varying the vertical direction of the blown air. The controller controls the orientations of the airflow direction adjustment vane and the Coanda vane when the orientation of the Coanda airflow is varied.

In this air-conditioning indoor unit, the airflow direction adjustment vane adjusts the airflow direction of the blown air toward the curved surface of the Coanda vane, the Coanda vane changes the blown air of which the airflow direction has been adjusted to a Coanda airflow along the curved surface thereof, and the effect of deflecting the airflow direction is therefore great.

An air-conditioning indoor unit according to an eighth aspect of the present invention is the air-conditioning indoor unit according to the first aspect, wherein the controller adjusts the orientation of the Coanda vane during the Coanda effect use mode so that the rear end of the Coanda vane is oriented downward and the distal end of the Coanda vane is oriented upward.

In this air-conditioning indoor unit, because the rear end of the Coanda vane is oriented downward, the rear end has the same angle as the angle of the scroll itself, i.e. a nearly downward-oriented angle, and the blown air flows readily along the Coanda vane. If the rear end is oriented upward, the gap with the scroll angle is greater, and the blown air ceases to flow along the Coanda vane.

Because the distal end of the Coanda vane is oriented upward and the rear end is oriented downward, the airflow can be made to flow along the bottom surface by the rear end of the Coanda vane so as to intercept the draft, and the airflow can be gradually shifted upward.

An air-conditioning indoor unit according to a ninth aspect of the present invention is the air-conditioning indoor unit according to any of the first through eighth aspects, wherein the radius of the curved surface of the Coanda vane is 50 to 300 mm.

In this air-conditioning indoor unit, the breaking away of the Coanda airflow from the curved surface can be suppressed, and the degree of deflection can be increased from the direction of the blown air to the direction of the Coanda airflow.

Advantageous Effects of Invention

In the air-conditioning indoor unit according to the first aspect of the present invention, upward blowing of the blown air can be achieved, and short circuiting can be prevented even though the intake port is above the casing front surface. Furthermore, the distance between the distal end of the Coanda vane and the casing front surface can be ensured, and a Coanda airflow free of short circuiting can be created.

In the air-conditioning indoor unit according to the second aspect of the present invention, even though the tangent to the final end of the scroll is oriented downward, the blown air is an upward Coanda airflow along the curved surface of the Coanda vane, and the blown air is also an airflow free of short circuiting even without a conventional airflow guide plate.

In the air-conditioning indoor unit according to the third aspect of the present invention, ceiling blowing of air can be achieved, and short circuiting can be prevented even though the intake port is above the casing front surface.

In the air-conditioning indoor unit according to the fourth aspect of the present invention, in the top side of the Coanda vane, the airflow is suppressed from progressing straight at a downward incline along the bottom wall in the farthest downstream side of the blow-out port, and the upward diversion of the Coanda airflow is therefore not likely to be inhibited.

In the air-conditioning indoor unit according to the fifth aspect of the present invention, the casing front surface has a good appearance when the Coanda vane is accommodated, and the design is not compromised.

In the air-conditioning indoor unit according to the sixth aspect of the present invention, by gradually increasing the degree of deflection with a plurality of curved surfaces, the breaking away of the Coanda airflow from the curved surface can be suppressed, and the degree of deflection can be increased from the direction of the blown air to the direction of the Coanda airflow.

In the air-conditioning indoor unit according to the seventh aspect of the present invention, the airflow direction adjustment vane adjusts the airflow direction of the blown air toward the curved surface of the Coanda vane, the Coanda vane changes the blown air of which the airflow direction has been adjusted to a Coanda airflow along the curved surface thereof, and the effect of deflecting the airflow direction is therefore great.

In the air-conditioning indoor unit according to the eighth aspect of the present invention, because the rear end of the Coanda vane is oriented downward, the rear end has the same angle as the angle of the scroll itself, i.e. a nearly downward-oriented angle, and the blown air flows readily along the Coanda vane. The airflow can also be made to flow along the bottom surface by the rear end of the Coanda vane so as to intercept the draft, and the airflow can be gradually shifted upward.

In the air-conditioning indoor unit according to the ninth aspect, the breaking away of the Coanda airflow from the curved surface can be suppressed, and the degree of deflection can be increased from the direction of the blown air to the direction of the Coanda airflow.

DESCRIPTION OF EMBODIMENTS

Embodiments of the present invention are described below with reference to the drawings. The following embodiments are specific examples of the present invention and are not intended to limit the technical scope of the present invention.

(1) Configuration of Air-Conditioning Indoor Unit 10

Figure 1:
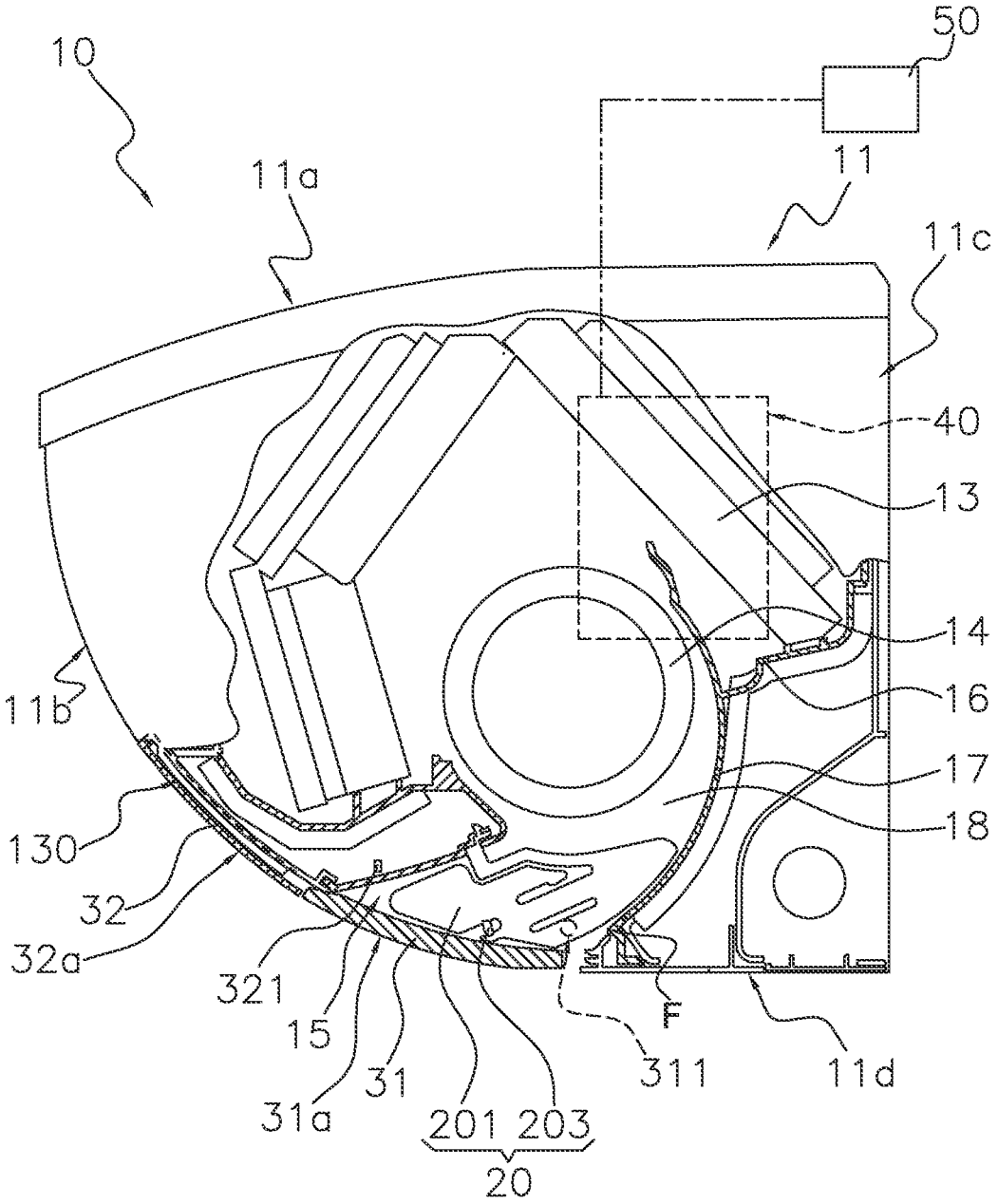
FIG. 1 is a cross-sectional view of an air-conditioning indoor unit according to an embodiment of the present invention when operation has stopped.
Figure 2:
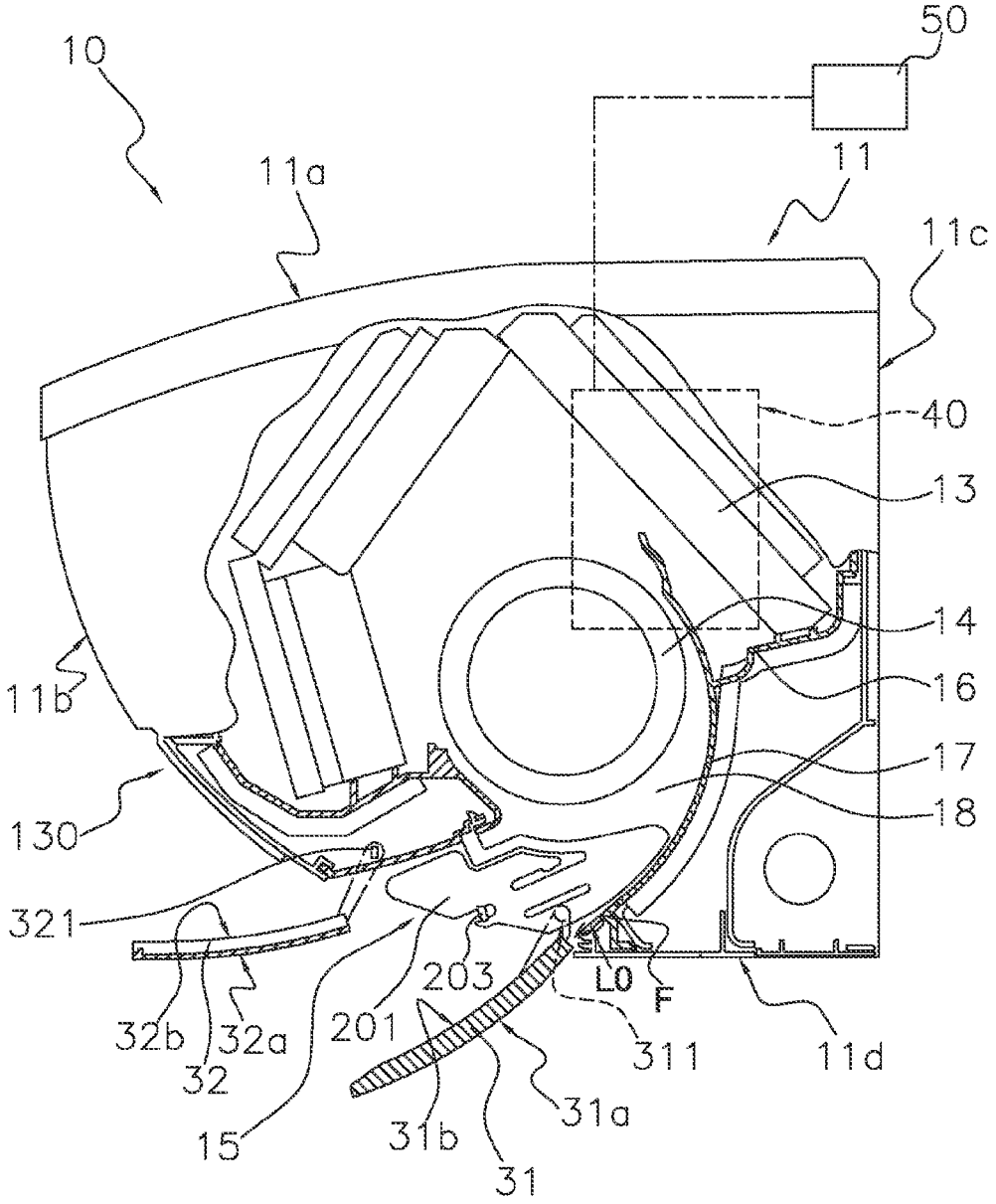
FIG. 2 is a cross-sectional view of the air-conditioning indoor unit while operating.

FIG. 1 is a cross-sectional view of an air-conditioning indoor unit 10 according to an embodiment of the present invention when operation has stopped. FIG. 2 is a cross-sectional view of the air-conditioning indoor unit 10 while operating. In FIGS. 1 and 2, the air-conditioning indoor unit 10 is a wall-mounted type unit, equipped with a main body casing 11, an indoor heat exchanger 13, an indoor fan 14, a bottom frame 16, and a controller 40.

The main body casing 11 has a top surface part 11*a*, a front surface panel 11*b*, a back surface plate 11*c*, and a bottom horizontal plate 11*d*, and the interior of the casing accommodates the indoor heat exchanger 13, the indoor fan 14, the bottom frame 16, and the controller 40.

The top surface part 11*a* is positioned in the top of the main body casing 11 and an intake port (not shown) is provided in the front of the top surface part 11*a*.

The front surface panel 11*b* constitutes the front surface part of the indoor unit, and has a flat shape with no intake port. The front surface panel 11*b* is also turnably supported at the top end on the top surface part 11*a*, and can be actuated in the manner of a hinge.

The indoor heat exchanger 13 and the indoor fan 14 are attached to the bottom frame 16. The indoor heat exchanger 13 conducts heat exchange with air passing therethrough. The indoor heat exchanger 13 also has a shape of inverted V that is bent with both ends extending downward as seen in a side view, and the indoor fan 14 is positioned under the indoor heat exchanger 13. The indoor fan 14, which is a cross flow fan, blows the air taken from within the room back out into the room after causing the air to pass through while in contact with the indoor heat exchanger 13.

A blow-out port 15 is provided in the bottom part of the main body casing 11. The blow-out port 15 is provided with a turnable airflow direction adjustment vane 31 for varying the direction of blown air that is blown out from the blow-out port 15. The airflow direction adjustment vane 31, which is driven by a motor (not shown), not only varies the direction of the blown air but can also open and close the blow-out port 15. The airflow direction adjustment vane 31 can assume a plurality of orientations of different incline angles.

A Coanda vane 32 is provided in proximity to the blow-out port 15. The Coanda vane 32 can be made by a motor (not shown) to assume an orientation inclined in the forward-backward direction, and when operation has stopped, the vane is accommodated in an accommodation part 130 provided to the front surface panel 11*b*. The Coanda vane 32 can assume a plurality of orientations of different incline angles.

The blow-out port 15 is joined with the interior of the main body casing 11 by a blow-out flow channel 18. The blow-out flow channel 18 is formed from the blow-out port 15 along a scroll 17 of the bottom frame 16.

Indoor air is drawn into the indoor fan 14 via the intake port and the indoor heat exchanger 13 by the working of the indoor fan 14, and is blown out from the indoor fan 14 and then from the blow-out port 15 via the blow-out flow channel 18.

The controller 40 is positioned to the right of the indoor heat exchanger 13 and the indoor fan 14 when the main body casing 11 is viewed from the front surface panel 11*b*, and the controller controls rotational speed of the indoor fan 14 and the actuating of the airflow direction adjustment vane 31 and the Coanda vane 32.

(2) Detailed Configuration (2-1) Front Surface Panel 11*b*

The front surface panel 11*b* extends in a slight arcuate curve from the top front of the main body casing 11 toward the front edge of the bottom horizontal plate 11*d*, as shown in FIG. 1. In the bottom part of the front surface panel 11*b* there is an area recessed toward the inside of the main body casing 11. The recessed depth of this area is set so as to match the thickness dimension of the Coanda vane 32, and this area constitutes the accommodation part 130 where the Coanda vane 32 is accommodated. The surface of the accommodation part 130 also has a slight curve.

(2-2) Blow-Out Port 15

The blow-out port 15, which is formed in the bottom part of the main body casing 11 as shown in FIG. 1, is a rectangular opening the long sides of which run in the horizontal direction (the direction orthogonal to the image plane of FIG. 1). The bottom end of the blow-out port 15 touches the front edge of the bottom horizontal plate 11*d*, and an imaginary plane joining the bottom and top ends of the blow-out port 15 is inclined forward and upward.

(2-3) Scroll 17

The scroll 17 is a dividing wall curved so as to face the indoor fan 14, and is part of the bottom frame 16. The final end F of the scroll 17 reaches the peripheral edge proximity of the blow-out port 15. Air passing through the blow-out flow channel 18 progresses along the scroll 17, and the air is sent tangentially to the final end F of the scroll 17. Therefore, if the blow-out port 15 did not have the airflow direction adjustment vane 31, the airflow direction of air blown out from the blow-out port 15 would flow substantially along a tangent L0 to the final end F of the scroll 17.

(2-4) Vertical Airflow Direction Adjustment Plate 20

A vertical airflow direction adjustment plate 20 has a plurality of vane pieces 201 and a linking rod 203 for linking the plurality of vane pieces 201 as shown in FIGS. 1 and 2. The vertical airflow direction adjustment plate 20 is disposed nearer to the indoor fan 14 than the airflow direction adjustment vane 31 within the blow-out flow channel 18.

The vane pieces 201 move left and right centered about a vertical state relative to the longitudinal direction of the blow-out port 15, due to the horizontal back-and-forth movement of the linking rod 203 along the longitudinal direction. The linking rod 203 is moved horizontally back and forth by a motor (not shown).

(2-5) Airflow Direction Adjustment Vane 31

The airflow direction adjustment vane 31 has a surface area sufficient to close the blow-out port 15. With the airflow direction adjustment vane 31 in a state of closing the blow-out port 15, the outer surface 31*a* thereof is finished to a convex and slightly arcuate curved surface in the outer side so as to be an extension of the curved surface of the front surface panel 11*b*. The inner surface 31*b* (see FIG. 2) of the airflow direction adjustment vane 31 is an arcuate curved surface substantially parallel to the outer surface.

The airflow direction adjustment vane 31 has a turning shaft 311 at the bottom end. The turning shaft 311, which is in proximity to the bottom end of the blow-out port 15, is linked to a rotating shaft of a stepping motor (not shown) fixed to the main body casing 11.

The turning shaft 311 turns counterclockwise in the front view of FIG. 1, whereby the top end of the airflow direction adjustment vane 31 is actuated so as to draw away from the top end of the blow-out port 15, thus opening the blow-out port 15. Conversely, the turning shaft 311 turns clockwise in the front view of FIG. 1, whereby the top end of the airflow direction adjustment vane 31 is actuated so as to draw near the top end of the blow-out port 15, thus closing the blow-out port 15.

With the airflow direction adjustment vane 31 in a state of leaving the blow-out port 15 open, the air blown out from the blow-out port 15 flows substantially along the inner surface 31*b* of the airflow direction adjustment vane 31. Specifically, the air blown out substantially tangentially to the final end F of the scroll 17 is varied in terms of airflow direction somewhat upward by the airflow direction adjustment vane 31.

(2-6) Coanda Vane 32

The Coanda vane 32 is accommodated in the accommodation part 130 while air-conditioning operation has stopped and during operation in a normal blow-out mode, described hereinafter. The Coanda vane 32 separates from the accommodation part 130 by turning. A turning shaft 321 of the Coanda vane 32 is provided to a position in proximity to the bottom end of the accommodation part 130 and on the inner side of the main body casing 11 (a position above the top wall of the blow-out flow channel 18), and the bottom end of the Coanda vane 32 and the turning shaft 321 are linked with a predetermined gap in between them. Therefore, the more the turning shaft 321 turns and the farther the Coanda vane 32 separates from the accommodation part 130 in the casing front surface, the more the Coanda vane 32 rotates so that the bottom end thereof is positioned at a lower height. The incline when the Coanda vane 32 has rotated open is less than the incline of the casing front surface.

In the present embodiment, the accommodation part 130 is provided outside of a blowing path, and the entire Coanda vane 32 when accommodated is accommodated on the outside of the blowing path. An alternative to this structure is one in which only part of the Coanda vane 32 is accommodated on the outside of the blowing path and the rest is accommodated within the blowing path (in the top wall part of the blowing path, for example).

The turning shaft 321 turns counterclockwise in the front view of FIG. 1, whereby both the top and bottom ends of the Coanda vane 32 separate from the accommodation part 130 while moving in an arc; but at this time, the shortest distance between the top end and the accommodation part 130 in the casing front surface above the blow-out port is greater than the shortest distance between the bottom end and the accommodation part 130. Specifically, the Coanda vane 32 is controlled in an orientation so as to separate from the casing front surface as the vane moves forward. The turning shaft 321 then turns clockwise in the front view of FIG. 1, whereby the Coanda vane 32 draws near the accommodation part 130 and is ultimately accommodated in the accommodation part 130. The orientations of the Coanda vane 32 in an operating state include being accommodated in the accommodation part 130, rotating to be inclined forward and upward, further rotating to be substantially horizontal, and further rotating to be inclined forward and downward.

With the Coanda vane 32 accommodated in the accommodation part 130, the outer surface 32*a* of the Coanda vane 32 is finished to a convex and slightly arcuate curved surface in the outer side so as to be an extension of the slightly arcuate curved surface of the front surface panel 11*b*. The inner surface 32*b* of the Coanda vane 32 is finished to an arcuate curved surface so as to run along the surface of the accommodation part 130.

The longitudinal dimension of the Coanda vane 32 is set so as to be equal to or greater than the longitudinal dimension of the airflow direction adjustment vane 31. The reason for this is because all of the blown air of which the airflow direction is adjusted by the airflow direction adjustment vane 31 is received by the Coanda vane 32, and the purpose is to prevent blown air from the sides of the Coanda vane 32 from short circuiting.

(3) Blown Air Direction Control

As means for controlling the direction of blown air, the air-conditioning indoor unit of the present embodiment has a normal blowing mode in which only the airflow direction adjustment vane 31 is turned to adjust the direction of blown air, a Coanda effect use mode in which the airflow direction adjustment vane 31 and the Coanda vane 32 are turned to make the blown air into a Coanda airflow along the outer surface 32*a* of the Coanda vane 32 due to the Coanda effect, and a blow down mode in which the distal ends of both the airflow direction adjustment vane 31 and the Coanda vane 32 are oriented forward and downward to lead the blown air downward.

Because the orientations of the airflow direction adjustment vane 31 and the Coanda vane 32 change with each blown direction of air in the modes described above, the orientations are described with reference to FIGS. 3A to 3E. The blown direction can be selected by the user through a remote control or the like. The mode and blown direction can also be controlled so as to vary automatically.

(3-1) Normal Blowing Mode

The normal blowing mode is a mode in which only the airflow direction adjustment vane 31 is turned to adjust the direction of blown air, and this mode includes "normal forward blowing" and "normal forward-downward blowing."

(3-1-1) Normal Forward Blowing

Figure 3A:
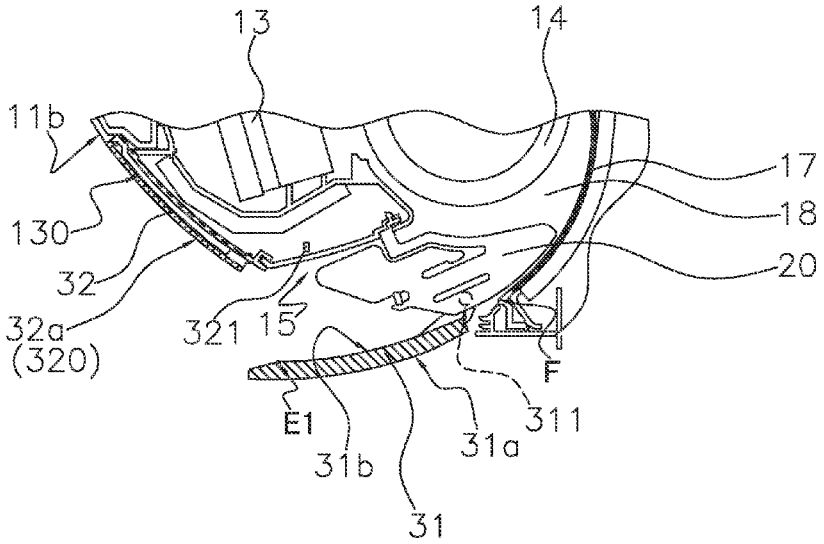
FIG. 3A is a side view of the airflow direction adjustment vane and the Coanda vane during normal forward blowing of blown air.
Figure 3B:
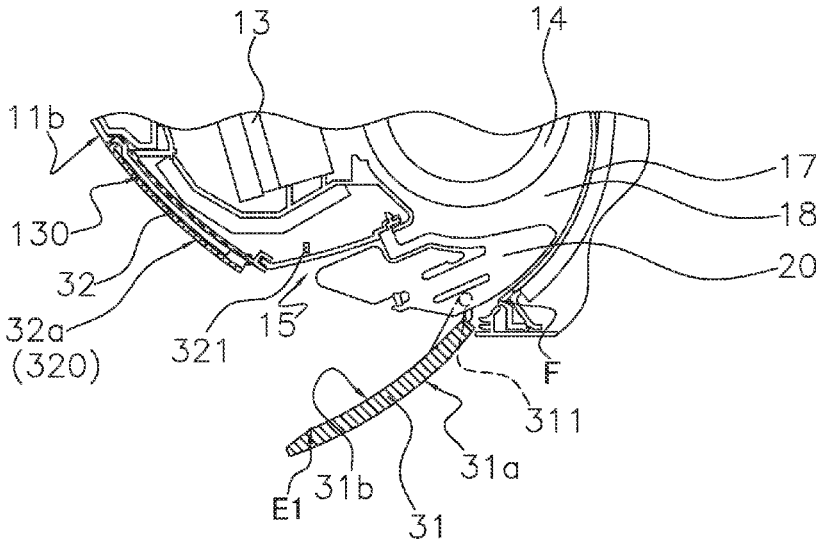
FIG. 3B is a side view of the airflow direction adjustment vane and the Coanda vane during normal forward-downward blowing of blown air.

FIG. 3A is a side view of the airflow direction adjustment vane 31 and the Coanda vane 32 during normal forward blowing of blown air. In FIG. 3A, when the user selects "normal forward blowing," the controller 40 turns the airflow direction adjustment vane 31 until the inner surface 31*b* of the airflow direction adjustment vane 31 comes to a substantially horizontal position. When the inner surface 31*b* of the airflow direction adjustment vane 31 has an arcuate curved surface as in the present embodiment, the airflow direction adjustment vane 31 is turned until a tangent to the front end E1 of the inner surface 31*b* is substantially horizontal. As a result, the blown air is in a forward blowing state, (3-1-2) Normal Forward-Downward Blowing FIG. 3B is a side view of the airflow direction adjustment vane 31 and the Coanda vane 32 during normal forward-downward blowing of blown air. In FIG. 3B, the user should select "normal forward-downward blowing" when desiring the blown direction to be further down than "normal forward blowing."

At this time, the controller 40 turns the airflow direction adjustment vane 31 until the tangent to the front end E1 of the inner surface 31*b* of the airflow direction adjustment vane 31 is oriented more forward and downward than horizontal. As a result, the blown air is in a forward-downward blowing state.

(3-2) Coanda Effect Use Mode

The term Coanda (effect) refers to a phenomenon whereby, when there is a wall next to a flow of a gas or liquid, the flow diverts toward a direction along the wall surface even if the flow direction and wall direction are different (Hösoku no jiten, Asakura Publishing Co., Ltd.). The Coanda effect use mode includes "Coanda airflow forward blowing" and "Coanda airflow ceiling blowing" which use the Coanda effect.

Figure 4A:
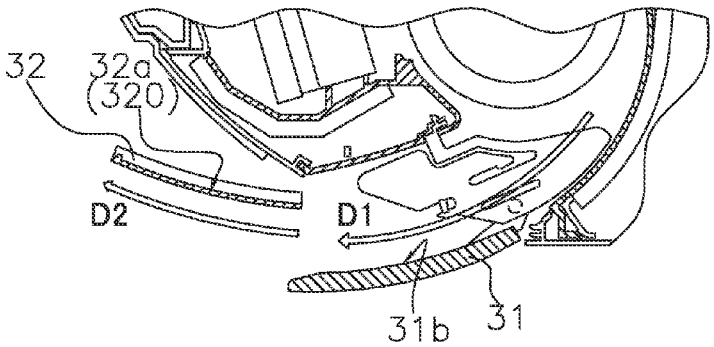
FIG. 4A is a schematic drawing showing the blown air direction and the Coanda airflow direction.

The method for defining the blown air direction and the Coanda airflow direction differs depending on how the reference position is found, and one example is therefore given below. However, the method is not limited to this example. FIG. 4A is a schematic drawing showing the blown air direction and the Coanda airflow direction. In FIG. 4A, to create a Coanda effect on the outer surface 32*a* of the Coanda vane 32, the incline of the blown air direction (D1) varied by the airflow direction adjustment vane 31 must be close to the orientation (incline) of the Coanda vane 32. When the two are too far apart, there is no Coanda effect. Therefore, in the present Coanda effect use mode, the Coanda vane 32 and the airflow direction adjustment vane 31 must have a predetermined opening angle or less, and both adjustment vanes (31, 32) are brought within this range to give rise to the relationship described above. After the airflow direction of the blown air is changed to D1 by the airflow direction adjustment vane 31, it is then changed to D2 by the Coanda effect as shown in FIG. 4A.

In the Coanda effect use mode of the present embodiment, the Coanda vane 32 is preferably in a position in front of (downstream of the blowing) and above the airflow direction adjustment vane 31.

Figure 4B:
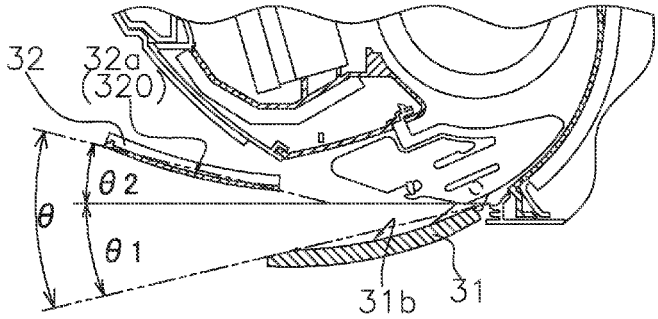
FIG. 4B is a schematic drawing showing an example of the opening angle between the airflow direction adjustment vane and the Coanda vane.

The method for defining the opening angle between the airflow direction adjustment vane 31 and the Coanda vane 32 differs depending on how the reference position is found, and one example is therefore given below. However, the method is not limited to this example. FIG. 4B is a schematic drawing showing an example of the opening angle of the airflow direction adjustment vane 31 and the Coanda vane 32. In FIG. 4B, the opening angle θ between the airflow direction adjustment vane 31 and the Coanda vane 32 is expressed as $\theta=\theta 2-\theta 1$, wherein the angle between a horizontal line and a straight line joining the front and rear ends of the inner surface 31*b* of the airflow direction adjustment vane 31 is the incline angle θ1 of the airflow direction adjustment vane 31, and the angle between the horizontal line and a straight line joining the front and rear ends of the outer surface 32*a* of the Coanda vane 32 is the incline angle θ2 of the Coanda vane 32. θ1 and θ2 are not absolute values, but are negative values when below the horizontal line in the front view of FIG. 4B.

In both "Coanda airflow forward blowing" and "Coanda airflow ceiling blowing," the airflow direction adjustment vane 31 and the Coanda vane 32 preferably assume orientations in which the inner angle formed by the tangent to the final end F of the scroll 17 and the Coanda vane 32 is greater than the inner angle formed by the tangent to the final end F of the scroll 17 and the airflow direction adjustment vane 31.

Figure 5A:
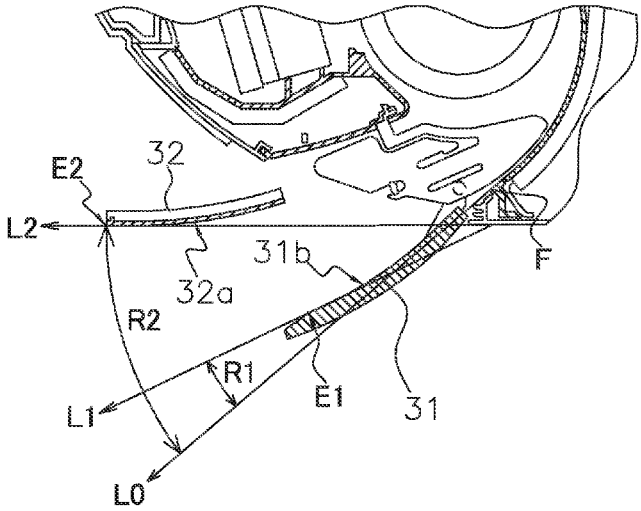
FIG. 5A is a comparative drawing, during Coanda airflow forward blowing, of the inner angle formed by the tangent to the final end F of the scroll and the Coanda vane, and the inner angle formed by the tangent to the final end F of the scroll and the airflow direction adjustment vane.
Figure 5B:
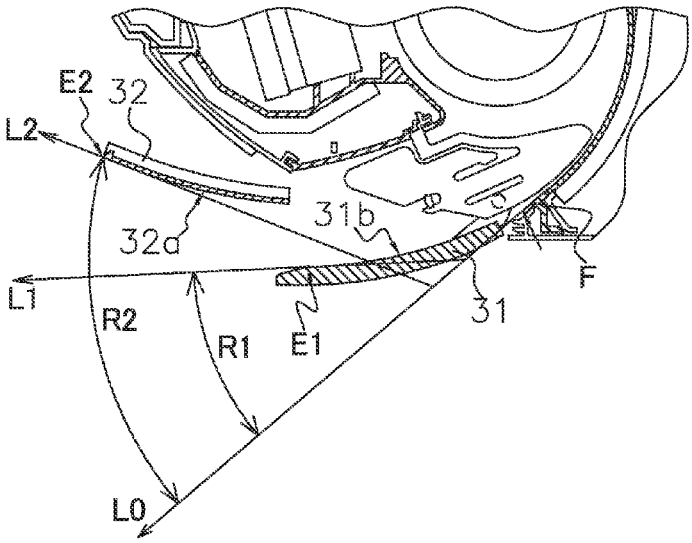
FIG. 5B a comparative drawing, during Coanda airflow ceiling blowing, of the inner angle formed by the tangent to the final end F of the scroll and the Coanda vane, and the inner angle formed by the tangent to the final end F of the scroll and the airflow direction adjustment vane.

For the inner angle, refer to FIG. 5A (a comparative drawing, during Coanda airflow forward blowing, of the inner angle R2 formed by the tangent L0 to the final end F of the scroll 17 and the Coanda vane 32, and the inner angle R1 formed by the tangent L0 to the final end F of the scroll 17 and the airflow direction adjustment vane 31) and FIG. 5B (a comparative drawing, during Coanda airflow ceiling blowing, of the inner angle R2 formed by the tangent L0 to the final end F of the scroll 17 and the Coanda vane 32, and the inner angle R1 formed by the tangent L0 to the final end F of the scroll 17 and the airflow direction adjustment vane 31).

In the Coanda vane 32 during the Coanda effect use mode as shown in FIG. 5B, the distal end of the Coanda vane 32 is forward and above being horizontal, and is positioned farther outward and above the blow-out port 15. As a result, the Coanda airflow reaches further, and upward diverting of the Coanda airflow is not likely to be inhibited because the airflow is suppressed from progressing straight at a decline along the scroll 17 in the top side of the Coanda vane 32.

The Coanda airflow is also created easily by the Coanda effect in the upstream side because the rear end of the Coanda vane 32 is at a lower height position than when operation has stopped.

(3-2-1) Coanda Airflow Forward Blowing

Figure 3C:
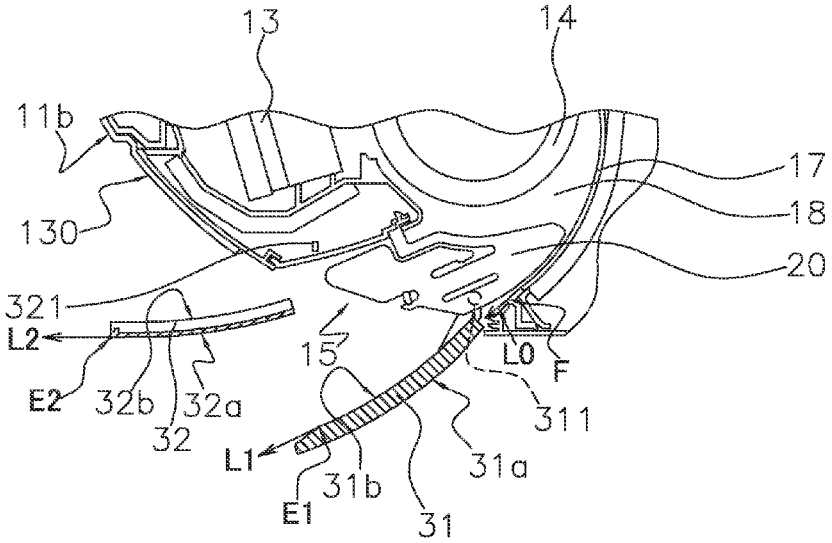
FIG. 3C is a side view of the airflow direction adjustment vane and the Coanda vane during Coanda airflow forward blowing.

FIG. 3C is a side view of the airflow direction adjustment vane 31 and the Coanda vane 32 during Coanda airflow forward blowing. In FIG. 3C, when "Coanda airflow forward blowing" is selected, the controller 40 turns the airflow direction adjustment vane 31 until the tangent L1 to the front end E1 of the inner surface 31*b* of the airflow direction adjustment vane 31 is forward and lower than being horizontal.

Next, the controller 40 turns the Coanda vane 32 until the outer surface 32*a* of the Coanda vane 32 reaches a substantially horizontal position. When the outer surface 32*a* of the Coanda vane 32 has an arcuate curved surface as in the present embodiment, the Coanda vane 32 is turned until the tangent L2 to the front end E2 of the outer surface 32*a* is substantially horizontal. In other words, the inner angle R2 formed by the tangent L0 and the tangent L2 is greater than the inner angle R1 formed by the tangent L0 and the tangent L1, as shown in FIG. 5A.

The blown air adjusted to forward-downward blowing by the airflow direction adjustment vane 31 flows against the outer surface 32*a* of the Coanda vane 32 due to the Coanda effect, and changes to a Coanda airflow along the outer surface 32*a*.

Therefore, even if the direction of the tangent L1 to the front end E1 of the airflow direction adjustment vane 31 is forward-downward blowing, the direction of the tangent L2 to the front end E2 of the Coanda vane 32 is horizontal, and the blown air is therefore blown out in the direction of the tangent 12 to the front end E2 of the outer surface 32*a* of the Coanda vane 32, i.e. in a horizontal direction, due to the Coanda effect.

Thus, the Coanda vane 32 separates from the casing front surface, lessening the incline, and the blown air is readily subjected to the Coanda effect further forward than the front surface panel 11*b*. As a result, even when the blown air of which the airflow direction is adjusted by the airflow direction adjustment vane 31 is blown forward and downward, the air is diverted horizontally by the Coanda effect. This means that the airflow direction is varied while pressure loss due to the draft resistance of the airflow direction adjustment vane 31 is suppressed.

(3-2-2) Coanda Airflow Ceiling Blowing

Figure 3D:
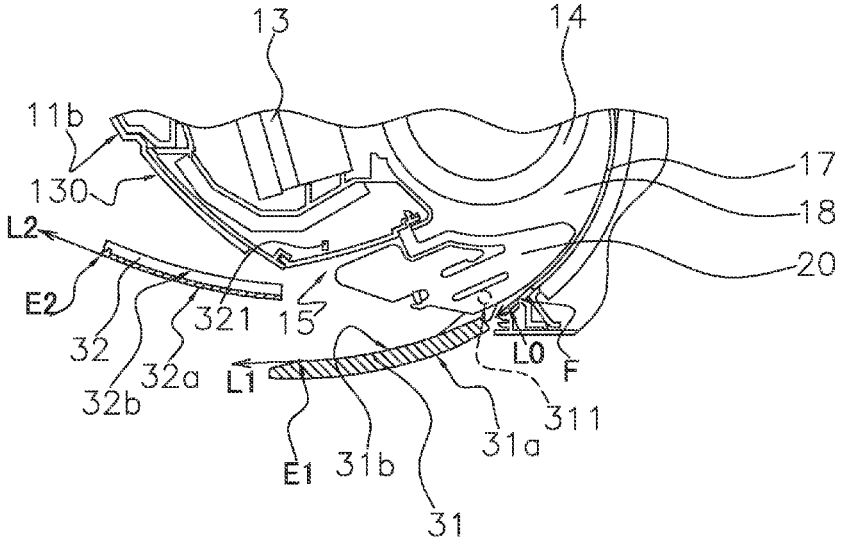
FIG. 3D is a side view of the airflow direction adjustment vane and the Coanda vane during Coanda airflow ceiling blowing.

FIG. 3D is a side view of the airflow direction adjustment vane 31 and the Coanda vane 32 during Coanda airflow ceiling blowing. In FIG. 3D, when "Coanda airflow ceiling blowing" is selected, the controller 40 turns the airflow direction adjustment vane 31 until the tangent L1 to the front end E1 of the inner surface 31*b* of the airflow direction adjustment vane 31 is horizontal.

Next, the controller 40 turns the Coanda vane 32 until the tangent L2 to the front end E2 of the outer surface 32*a* is oriented forward and upward. In other words, the inner angle R2 formed by the tangent L0 and the tangent L2 is greater than the inner angle R1 formed by the tangent L0 and the tangent L1, as shown in FIG. 5B. The blown air adjusted to horizontal blowing by the airflow direction adjustment vane 31 flows against the outer surface 32*a* of the Coanda vane 32 due to the Coanda effect, and changes to a Coanda airflow along the outer surface 32*a*.

Therefore, even when the direction of the tangent L1 to the front end E1 of the airflow direction adjustment vane 31 is forward blowing, the blown air is blown out in the direction of the tangent L2 to the front end E2 of the outer surface 32*a* of the Coanda vane 32, i.e. toward the ceiling due to the Coanda effect because the direction of the tangent L2 to the front end E2 of the Coanda vane 32 is forward-upward blowing. The Coanda airflow reaches farther because the distal end of the Coanda vane 32 protrudes farther outward than the blow-out port 15. Furthermore, because the distal end of the Coanda vane 32 is positioned higher than the blow-out port 15, the airflow is suppressed from progressing straight at a decline along the scroll 17 in the top side of the Coanda vane 32, and upward diverting of the Coanda airflow is therefore not likely to be inhibited.

Thus, the Coanda vane 32 separates from the casing front surface, lessening the incline, and the blown air is readily subjected to the Coanda effect farther forward than the front surface panel 11*b*. As a result, even when the blown air of which the airflow direction is adjusted by the airflow direction adjustment vane 31 is blown forward, the air is diverted upward by the Coanda effect. This means that the airflow direction is varied while pressure loss due to the draft resistance of the airflow direction adjustment vane 31 is suppressed.

As a result, the blown air is diverted toward the ceiling while the blow-out port 15 remains seemingly open. In other words, the blown air is diverted toward the ceiling while the draft resistance is kept low.

The longitudinal dimension of the Coanda vane 32 is at equal to or greater than the longitudinal dimension of the airflow direction adjustment vane 31. Therefore, all of the blown air of which the airflow direction is adjusted by the airflow direction adjustment vane 31 can be received by the Coanda vane 32, and the effect of preventing blown air from the sides of the Coanda vane 32 from short circuiting is also achieved.

(3-3) Downward Blowing Mode

Figure 3E:
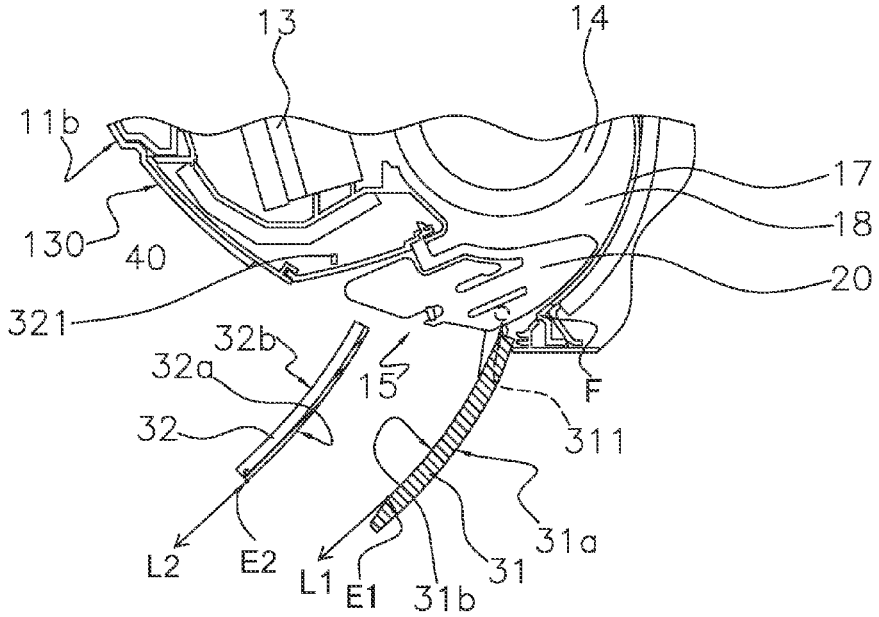
FIG. 3E is a side view of the airflow direction adjustment vane and the Coanda vane during downward blowing.

FIG. 3E is a side view of the airflow direction adjustment vane 31 and the Coanda vane 32 during downward blowing. In FIG. 3E, when "downward blowing" is selected, the controller 40 turns the airflow direction adjustment vane 31 until the tangent to the front end E1 of the inner surface 31*b* of the airflow direction adjustment vane 31 is oriented downward.

Next, the controller 40 turns the Coanda vane 32 until the tangent to the front end E2 of the outer surface 32*a* is oriented downward. As a result, the blown air is passed between the airflow direction adjustment vane 31 and the Coanda vane 32 and blown downward.

Particularly, even when the airflow direction adjustment vane 31 is oriented further downward than the tangent angle to the final end of the scroll 17, the controller 40 can create a downward airflow against the outer surface 32*a* of the Coanda vane 32 by implementing the downward blowing mode.

(4) Actuation

The actuation of the air-conditioning indoor unit, which uses the blown air direction control described above, is described below with reference to the drawings.

(4-1) First Orientation of Coanda Vane 32

Figure 6A:
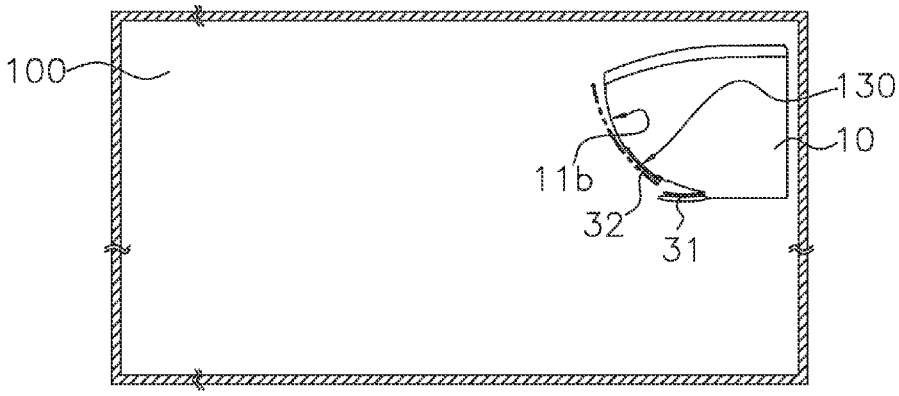
FIG. 6A is a side view of an installation space of the air-conditioning indoor unit, showing the airflow direction of the Coanda airflow when the Coanda vane assumes a first orientation.

FIG. 6A is a side view of an installation space of the air-conditioning indoor unit, showing the airflow direction of the Coanda airflow when the Coanda vane 32 assumes a first orientation. In FIG. 6A, the air-conditioning indoor unit 10 is installed at the top of an indoor side wall. The Coanda vane 32 is in a state of being accommodated in the accommodation part 130 (referred to hereinafter as the first orientation). Due to the orientation of the airflow direction adjustment vane 31 being more upward than horizontal when the Coanda vane 32 is in the first orientation, the blown air of which the airflow direction is adjusted by the inner surface 31*b* of the airflow direction adjustment vane 31 separates from the inner surface 31*b*, after which the direction of the air changes so as to be pulled to the outer surface 32*a* of the Coanda vane 32, and the air forms a first Coanda airflow and flows along the front surface panel 11*b* and the outer surface 32*a* of the Coanda vane 32.

The first orientation is selected when a short circuit has been formed. The purpose thereof is to dehumidify the room without creating the feeling of a cold draft, as is also disclosed in public domain literature (Japanese Laid-open Patent Application publication 10-9659).

Figure 7A:
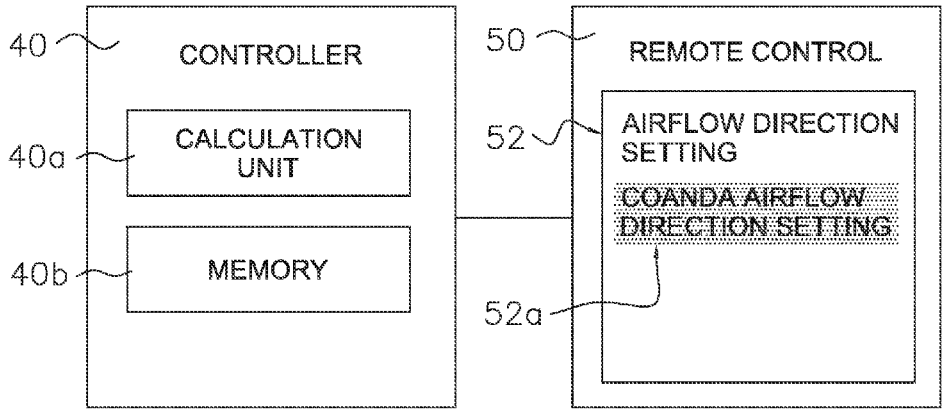
FIG. 7A is a block diagram showing the relationship between the controller and a remote control.

Herein is a description of the method whereby the user selects the Coanda airflow. FIG. 7A is a block diagram showing the relationship between the controller 40 and a remote control 50. In FIG. 7A, the remote control 50 transmits infrared signals wirelessly. The remote control 50 has switching means for switching the airflow direction. Specifically, the remote control has a display 52 for displaying airflow direction selection menus and a cursor 52*a* for indicating one of the airflow direction selection menus, so that the user can select the airflow direction.

First, the user uses the cursor 52*a* to select "Coanda airflow direction setting" from the menus displayed on the display 52. A detailed description is omitted because the techniques for selecting and confirming a menu through the remote control 50 are widely publically known.

Figure 7B:
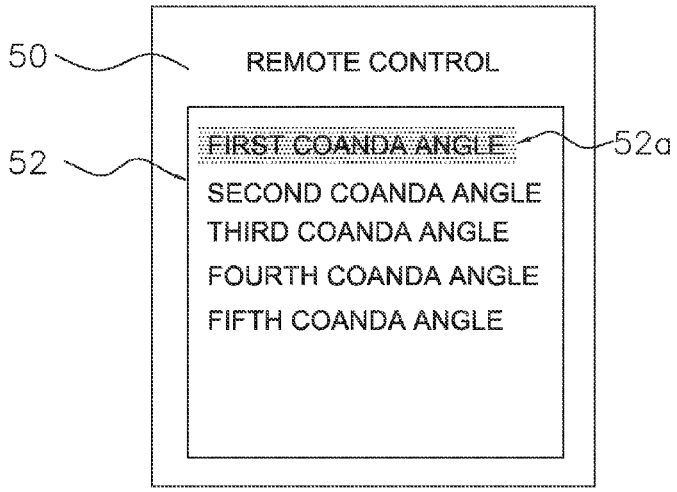
FIG. 7B is a front view of the display showing a sub-menu of the "Coanda airflow direction setting" menu.

FIG. 7B is a front view of the display 52 showing a sub-menu of the "Coanda airflow direction setting" menu. In FIG. 7B, first through fifth Coanda angles are prepared in advance on the sub-menu of the "Coanda airflow direction setting" menu and the first Coanda angle is indicated and confirmed with the cursor 52*a*, whereby the Coanda vane 32 assumes the first orientation shown in FIG. 6A, creating a Coanda airflow in a first direction corresponding to the first Coanda angle.

(4-2) Second Orientation and Third Orientation of Coanda Vane 32

Figure 6B:
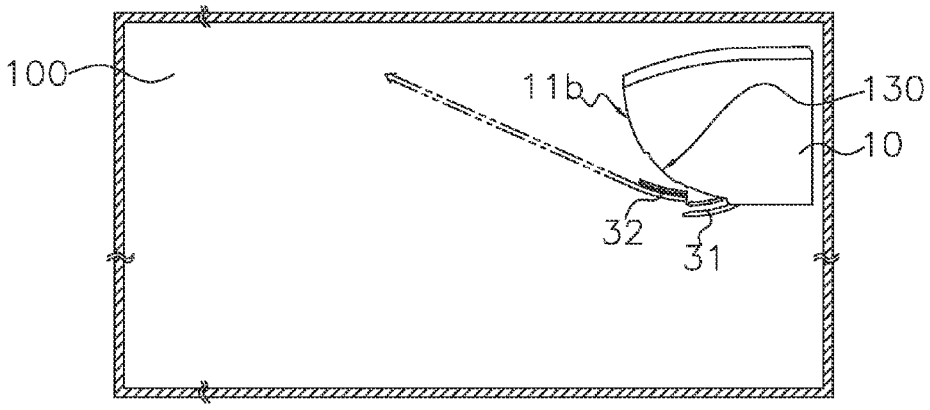
FIG. 6B is a side view of the installation space of the air-conditioning indoor unit, showing the airflow direction of Coanda airflow when the Coanda vane assumes a second orientation.

Next, FIG. 6B is a side view of the installation space of the air-conditioning indoor unit, showing the airflow direction of the Coanda airflow when the Coanda vane 32 assumes the second orientation. The second orientation of the Coanda vane 32 in FIG. 6B is implemented by indicating and confirming the second Coanda angle with the cursor 52*a* in FIG. 7B. The Coanda airflow created when the Coanda vane 32 is in the second orientation is equivalent to the Coanda airflow described in the section "(3-2-2) Coanda airflow ceiling blowing." When the second Coanda angle is selected, the controller 40 turns the airflow direction adjustment vane 31 until the tangent L1 to the front end E1 of the inner surface 31*b* of the airflow direction adjustment vane 31 is horizontal, and then turns the Coanda vane 32 until the tangent L2 to the front end E2 of the outer surface 32*a* is oriented forward and upward, as shown in FIG. 3D. Therefore, even when the direction of the tangent L1 to the front end E1 of the airflow direction adjustment vane 31 is forward blowing, the blown air is blown out in the direction of the tangent L2 to the front end E2 of the outer surface 32*a* of the Coanda vane 32, i.e. toward the ceiling due to the Coanda effect, because the direction of the tangent E2 to the front end E2 of the Coanda vane 32 is forward-upward blowing.

Figure 8A:
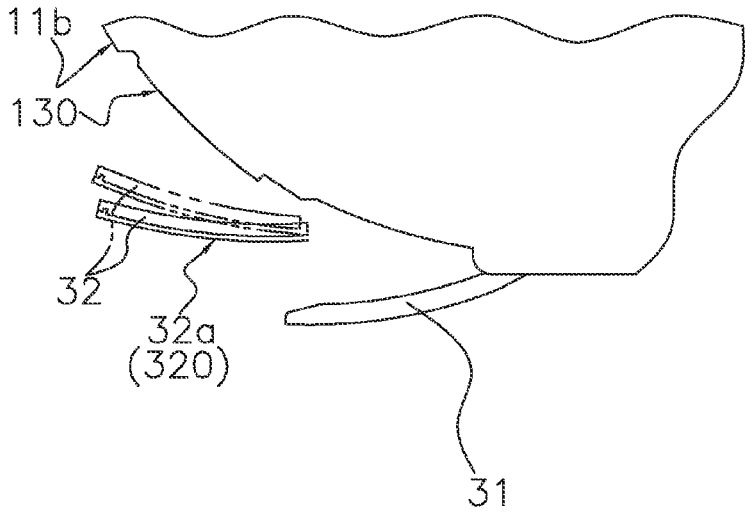
FIG. 8A is a side view of the airflow direction adjustment vane and the Coanda vane when the Coanda vane is in the third orientation.

Once a Coanda airflow has been created, the direction of the Coanda airflow can be adjusted by varying only the angle of the Coanda vane 32, without moving the airflow direction adjustment vane 31. For example, FIG. 8A is a side view of the airflow direction adjustment vane 31 and the Coanda vane 32 when the Coanda vane 32 is in the third orientation. In FIG. 8A, the third orientation of the Coanda vane 32 is further downward than the second orientation. For the sake of comparison in FIG. 8A, the Coanda vane 32 in the second orientation is shown by double-dashed lines, and the Coanda vane 32 in the third orientation is shown by solid lines.

Assuming a Coanda airflow is reliably created with the second orientation and the orientation of the airflow direction adjustment vane 31 does not change, it is clear that the Coanda airflow in the third orientation, which is further downward than the second orientation, does not break away from the outer surface 32*a* of the Coanda vane 32. Thus, when Coanda airflow ceiling blowing is to be implemented, it is achieved by selecting either the second Coanda angle or the third Coanda angle with the cursor 52*a* in FIG. 7B.

The second orientation and the third orientation of the Coanda vane 32 have a great airflow direction deflecting effect because the airflow direction of the blown air is adjusted by the airflow direction adjustment vane 31 to a direction approaching a curved surface 320 of the Coanda vane 32, and the Coanda vane 32 changes the blown air of which the airflow direction is adjusted to a Coanda airflow along the curved surface 320 thereof.

In the second orientation and the third orientation, the distal end of the Coanda vane 32 is oriented toward the ceiling, and the Coanda airflow along the curved surface 320 of the Coanda vane 32 can therefore progress toward the ceiling while separating from the front surface panel 11*b*. In this case, short circuiting can be prevented even though there is an intake port above the front surface of the main body casing 11.

Because the rear end of the Coanda vane 32 is oriented downward, on the other hand, the rear end is at the angle of the scroll 17 itself, i.e. a nearly downward angle, and the blown air readily flows along the Coanda vane 32. If the rear end is oriented upward, the gap with the scroll angle is increased and the blown air ceases to flow along the Coanda vane.

Furthermore, because the distal end of the Coanda vane 32 is oriented upward and the rear end is oriented downward, the airflow can be made to flow along the outer surface 32*a* by the rear end of the Coanda vane 32 so as to intercept the draft, and the airflow can be gradually shifted upward.

In the present embodiment, it is assumed that the second orientation and the third orientation of the Coanda vane 32 are selected to send conditioned air far. For example, when there is both a great height distance from the blow-out port 15 to the ceiling and a great opposing distance from the blow-out port 15 to the opposite wall, the orientation of the Coanda vane 32 is preferably the second orientation. On the other hand, in cases such as when there is a small height distance from the blow-out port 15 to the ceiling and a great opposing distance from the blow-out port 15 to the opposite wall, the orientation of the Coanda vane 32 is preferably the third orientation. Thus, the user can select the orientation of the Coanda vane 32 via the remote control 50 in accordance with the size of the indoor space, and conditioned air can therefore be spread evenly throughout the air conditioning target space in addition to the air conditioning indoor unit being easily usable.

(4-2-1) Shape of Coanda Vane 32

Concerning the shape of the Coanda vane 32 the outer surface 32*a* of the Coanda vane 32 may have a convex curved shape or a flat surface shape, but the outer surface 32*a* preferably has a convex curved shape for the following reasons.

In FIG. 8A, the outer surface 32*a* of the Coanda vane 32 is curved into a convex shape to form the curved surface 320. Because the orientation of the Coanda vane 32 is an orientation of separating from the front surface panel 11*b* the further away from the blow-out port 15, the Coanda airflow along the curved surface 320 of the Coanda vane 32 can progress upward while separating from the front surface panel 11*b*. The angle of the distal end of the Coanda vane 32 is an upward angle, and an upward airflow can be created without making the incline angle of the Coanda vane a steep angle.

Even when the tangent to the final end of the scroll 17 is oriented downward, the blown air is an upward Coanda airflow along the curved surface 320 of the Coanda vane 32.

Due to the front surface panel 11*b* and the curved surface 320 of the Coanda vane 32 being curved so as to align on a single consecutive imaginary curved plane, the appearance of the casing front surface is improved when the Coanda vane 32 is accommodated.

(4-3) Fourth Orientation and Fifth Orientation of the Coanda Vane 32

Figure 6C:
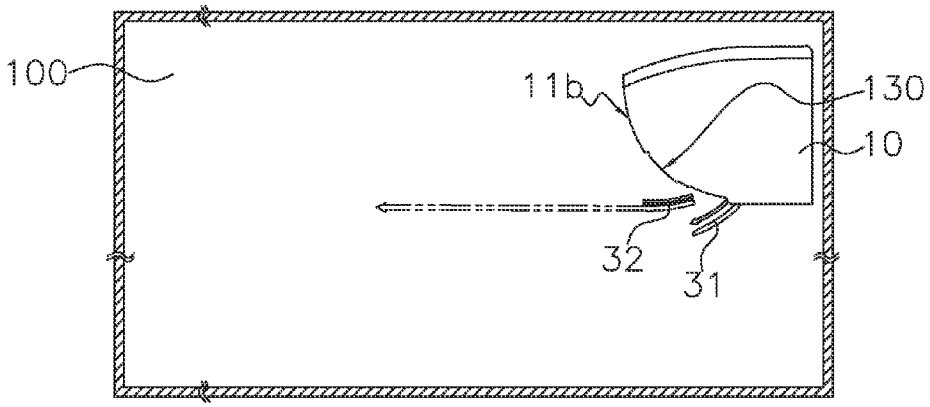
FIG. 6C is a side view of the installation space of the air-conditioning indoor unit, showing the airflow direction of the Coanda airflow when the Coanda vane assumes a fourth orientation.

Furthermore, FIG. 6C is a side view of the installation space of the air-conditioning indoor unit, showing the airflow direction of the Coanda airflow when the Coanda vane 32 assumes the fourth orientation. The fourth orientation of the Coanda vane 32 in FIG. 6C is implemented by indicating and confirming the fourth Coanda angle with the cursor 52*a* in FIG. 7B. The Coanda airflow created when the Coanda vane 32 is in the fourth orientation is equivalent to the Coanda airflow described in the section "(3-2-1) Coanda airflow forward blowing." When the fourth Coanda angle is selected, the controller 40 turns the airflow direction adjustment vane 31 until the tangent L1 to the front end E1 of the inner surface 31*b* of the airflow direction adjustment vane 31 is more forward and downward than horizontal, and then turns the Coanda vane 32 until the outer surface 32*a* of the Coanda vane 32 is substantially horizontal, as shown in FIG. 3C. Therefore, even when the direction of the tangent L1 to the front end E1 of the airflow direction adjustment vane 31 is forward-downward blowing, the blown air is blown out in the direction of the tangent L2 to the front end E2 of the outer surface 32*a* of the Coanda vane 32, i.e., horizontally, due to the Coanda effect, because the direction of the tangent L2 to the front end E2 of the Coanda vane 32 is horizontal.

Figure 8B:
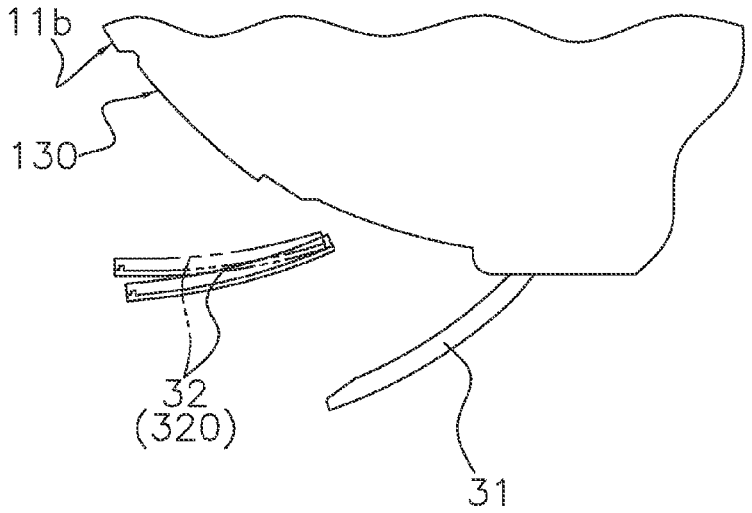
FIG. 8B is a side view of the airflow direction adjustment vane and the Coanda vane when the Coanda vane is in the fifth orientation.

Once a Coanda airflow has been created, the direction of the Coanda airflow can be adjusted by varying only the angle of the Coanda vane 32, without moving the airflow direction adjustment vane 31. For example, FIG. 8B is a side view of the airflow direction adjustment vane 31 and the Coanda vane 32 when the Coanda vane 32 is in the fifth orientation. In FIG. 8B, the fifth orientation of the Coanda vane 32 is further downward than the fourth orientation. For the sake of comparison in FIG. 8B, the Coanda vane 32 in the fourth orientation is shown by double-dashed lines, and the Coanda vane 32 in the fifth orientation is shown by solid lines.

Assuming a Coanda airflow is reliably created with the fourth orientation and the orientation of the airflow direction adjustment vane 31 does not change, it is clear that the Coanda airflow in the fifth orientation, which is further downward than the fourth orientation, does not break away from the outer surface 32*a* of the Coanda vane 32. Thus, when Coanda airflow upward blowing is to be implemented, it is achieved by selecting either the fourth Coanda angle or the fifth Coanda angle with the cursor 52*a* in FIG. 7B.

As is clear from the description above, the orientation of the airflow direction adjustment vane 31 varies with the first orientation, the second orientation, and the fourth orientation of the Coanda vane 32. In other words, the Coanda airflow created by the Coanda vane 32 can be directed in any direction by the combination of the orientation of the airflow direction adjustment vane 31 and the orientation of the Coanda vane 32.

(5) Characteristics (5-1)

In the air-conditioning indoor unit 10, the curved surface 320 which curves in a convex shape is formed in the outer surface 32*a* of the Coanda vane 32. Because the orientation of the Coanda vane 32 is an orientation that separates from the casing front surface the further away from the blow-out port 15, the Coanda airflow along the curved surface 320 of the Coanda vane 32 can progress upward while separating from the casing front surface. The angle of the distal end of the Coanda vane 32 is more of an upward angle than when the Coanda vane 32 has a flat plate shape, and an upward airflow can be created without making the incline angle of the Coanda vane 32 a steep angle.

(5-2)

In the air-conditioning indoor unit 10, the tangent to the final end of the scroll is oriented downward. The distal end of the Coanda vane 32, on the other hand, is oriented upward. Therefore, even though the tangent to the final end of the scroll 17 is oriented downward, the blown air becomes an upward Coanda airflow along the curved surface 320 of the Coanda vane 32.

(5-3)

In the air-conditioning indoor unit 10, the controller 40 adjusts the orientation of the Coanda vane 32 in the Coanda effect use mode so that the distal end of the Coanda vane 32 is oriented toward the ceiling. Because the distal end of the Coanda vane is oriented toward the ceiling, the Coanda airflow along the curved surface 320 of the Coanda vane 32 can progress toward the ceiling while separating from the casing front surface. As a result, ceiling blowing of air can be achieved, and short circuiting can be prevented even though an intake port is above the casing front surface.

(5-4)

In the air-conditioning indoor unit 10, an accommodation part 130 in which the Coanda vane 32 is accommodated is formed in the casing front surface. In the normal mode, the Coanda vane 32 is accommodated in the accommodation part 130, and the casing front surface and the curved surface 320 of the Coanda vane 32 are curved so as to be aligned in a single continuous imaginary curved plane. Therefore, the casing front surface has a good appearance when the Coanda vane 32 is accommodated, and the design is not compromised.

(5-5)

In the air-conditioning indoor unit 10, the curved surface 320 of the Coanda vane 32 is formed from a plurality of curved surfaces 320 having different degrees of curvature.

By gradually increasing the degree of deflection with a plurality of curved surfaces 320, the breaking away of the Coanda airflow from the curved surface 320 can be suppressed, and the degree of deflection can be increased from the direction of the blown air to the direction of the Coanda airflow.

(5-6)

In the air-conditioning indoor unit 10, the controller 40 controls the orientations of the airflow direction adjustment vane 31 and the Coanda vane 32 when the direction of the Coanda airflow is varied. The airflow direction adjustment vane 31 adjusts the airflow direction of the blown air toward the curved surface 320 of the Coanda vane 32, the Coanda vane 32 changes the blown air of which the airflow direction has been adjusted to a Coanda airflow along the curved surface 320 thereof, and the effect of deflecting the airflow direction is therefore great.

(5-7)

In the air-conditioning indoor unit 10, the controller 40 adjusts the orientation of the Coanda vane 32 during the Coanda effect use mode so that the rear end of the Coanda vane 32 is oriented downward and the distal end is oriented upward. Because the rear end of the Coanda vane 32 is oriented downward, the rear end has the same angle as the angle of the scroll itself, i.e. a nearly downward-oriented angle, and the blown air flows readily along the Coanda vane 32. If the rear end is oriented upward, the gap with the scroll angle is greater, and the blown air ceases to flow along the Coanda vane 32.

Because the distal end of the Coanda vane 32 is oriented upward and the rear end of the Coanda vane 32 is oriented downward, the airflow can be made to flow along the outer surface 32*a* by the rear end of the Coanda vane 32 so as to intercept the draft, and the airflow can be gradually shifted upward.

(5-8)

In the air-conditioning indoor unit 10, the radius of the curved surface 320 of the Coanda vane 32 is 50 to 300 mm. As a result, the breaking away of the Coanda airflow from the curved surface 320 can be suppressed, and the degree of deflection can be increased from the direction of the blown air to the direction of the Coanda airflow.

(6) Modifications

In the above embodiment, the curved surface 320 of the Coanda vane 32 is formed from a single curved surface, but may also be formed from a plurality of curved surfaces having different degrees of curvature.

Figure 9:
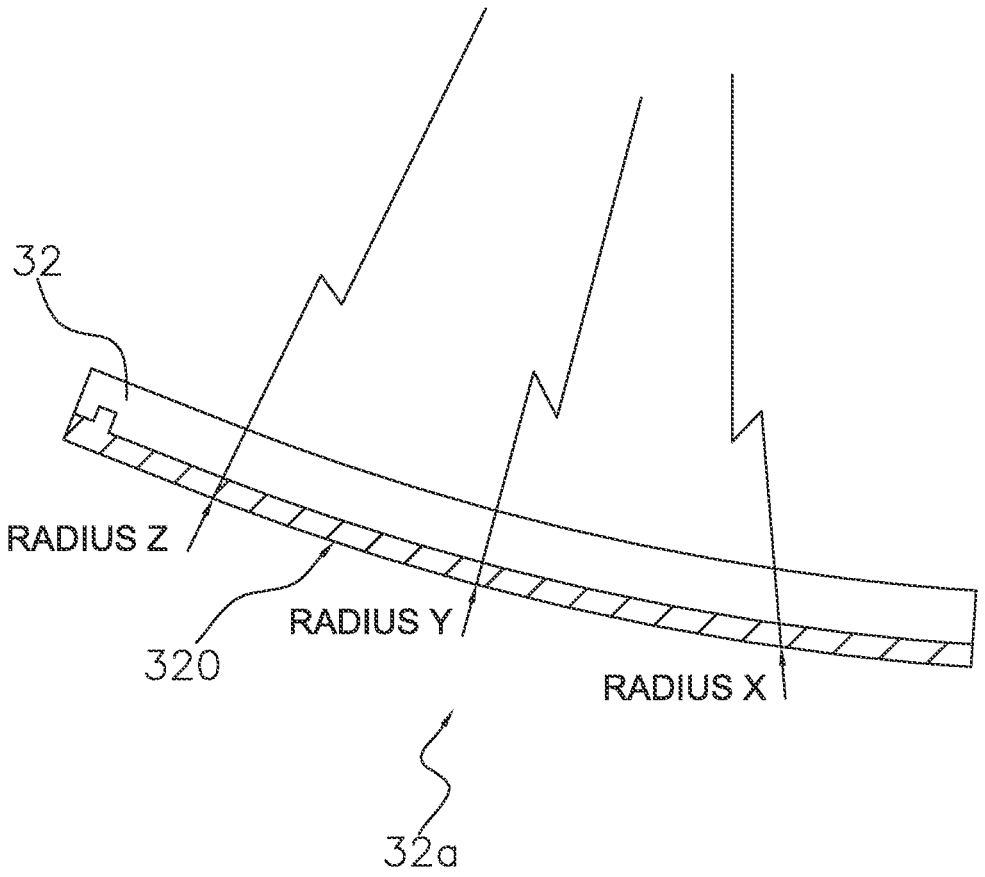
FIG. 9 is a side view of a Coanda vane of an air-conditioning indoor unit according to a modification.

FIG. 9 is a side view of a Coanda vane 32 of an air-conditioning indoor unit 10 according to a modification. In FIG. 9, the curved surface 320 of the Coanda vane 32 is formed from three arcuate surfaces having a radius X, a radius Y, and a radius Z. By gradually increasing the degree of deflection with a plurality of arcuate surfaces, the breaking away of the Coanda airflow from the curved surface can be suppressed, and the degree of deflection can be increased from the direction of the blown air to the direction of the Coanda airflow.

INDUSTRIAL APPLICABILITY

The present invention is useful as a wall-mounted air-conditioning indoor unit.

What is claimed is:

1. An air-conditioning indoor unit operable in a Coanda effect use mode in which a flow of blown air blown out from a blow-out port is diverted in a predetermined direction via the Coanda effect, which is a phenomenon whereby a gas attempts to flow in a direction along a surface next to the flow and in a different direction than the flow, the air-conditioning indoor unit comprising:

a front panel defining a front surface of the air-conditioning indoor unit;

a scroll arranged and configured to lead conditioned air to the blow-out port, a tangent to a final end of the scroll being oriented downward;

a Coanda vane arranged and configured to alter an airflow direction of the blown air via the Coanda effect and to turn the blown air into a Coanda airflow along a bottom surface thereof in the Coanda effect use mode;

a movable airflow direction adjustment vane arranged and configured to orient the blown air upward or downward; and a controller configured to control an orientation of the Coanda vane, a convex shaped curved surface being formed in the bottom surface of the Coanda vane, the controller being configured to adjust the orientation of the Coanda vane away from the front panel as the Coanda vane separates from the blow-out port in the Coanda effect use mode, and to adjust the orientation of the Coanda vane so that a distal end of the Coanda vane is oriented upward, and the distal end of the Coanda vane being positioned farther outward and upward than the blow-out port with an orientation more upward than horizontal in the Coanda effect use mode, with a position of a rear end of the Coanda vane in the Coanda effect use mode being at a lower height than a position of the rear end of the Coanda vane when operation has stopped.

2. The air-conditioning indoor unit according to claim 1, wherein the controller is further configured to adjust the orientation of the Coanda vane so that the distal end of the Coanda vane is oriented toward a ceiling in the Coanda effect use mode.

3. The air-conditioning indoor unit according to claim 2, wherein when the distal end of the Coanda vane is oriented toward the ceiling, the controller is further configured to adjust the orientation of the Coanda vane so that the distal end of the Coanda vane is positioned higher than a top wall of the blow-out port.

4. The air-conditioning indoor unit according to claim 1 further having a normal mode in which the Coanda vane does not create the Coanda airflow, wherein an accommodation part arranged and configured to accommodate the Coanda vane is formed in the front panel; and in the normal mode, the Coanda vane is accommodated in the accommodation part and the front panel and the curved surface of the Coanda vane are curved so as to be aligned along a single continuous imaginary curved surface.

5. The air-conditioning indoor unit according to claim 1, wherein the controller is further configured to control an orientation of the airflow direction adjustment vane and the orientation of the Coanda vane when the orientation of the Coanda airflow is varied.

6. The air-conditioning indoor unit according to claim 1, wherein the controller is further configured to adjust the orientation of the Coanda vane in the Coanda effect use mode so that the rear end of the Coanda vane is oriented downward and the distal end of the Coanda vane is oriented upward.

* * * * *